US007566107B2

(12) United States Patent
Kusunoki

(10) Patent No.: US 7,566,107 B2
(45) Date of Patent: Jul. 28, 2009

(54) IMAGE FORMING APPARATUS

(75) Inventor: Naoki Kusunoki, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 320 days.

(21) Appl. No.: 11/715,136

(22) Filed: Mar. 8, 2007

(65) Prior Publication Data

US 2007/0211091 A1 Sep. 13, 2007

(30) Foreign Application Priority Data

Mar. 9, 2006 (JP) ..... 2006-064731

(51) Int. Cl.
*B41J 29/38* (2006.01)
*B41J 2/145* (2006.01)

(52) U.S. Cl. ..... 347/9; 347/40; 347/15

(58) Field of Classification Search ..... 347/9
See application file for complete search history.

(56) References Cited

U.S. PATENT DOCUMENTS 6,102,538 A * 8/2000 Ochi et al. ..... 347/20
2003/0039762 A1* 2/2003 Watanabe et al. ..... 427/422
2003/0058305 A1* 3/2003 Murakami et al. ..... 347/47

FOREIGN PATENT DOCUMENTS

JP 03211057 A * 9/1991
JP 7-137240 A 5/1995

* cited by examiner

*Primary Examiner*—Lamson Nguyen
*Assistant Examiner*—Shelby Fidler
(74) *Attorney, Agent, or Firm*—Birch, Stewart, Kolasch & Birch, LLP

(57) ABSTRACT

The image forming apparatus includes a liquid ejection head and an ejection control device. The liquid ejection head includes: a large nozzle and a small nozzle performing ejection of droplets of liquid, the droplet ejected from the large nozzle having volume larger than the droplet ejected from the small nozzle; and liquid flow channels corresponding to the large and small nozzles, the ejection of the droplets from the large and small nozzles being induced by formation of bubbles in the liquid in the corresponding liquid flow channels caused by applied thermal energy. The ejection control device controls the ejection of the droplets in such a manner that a product of a Reynolds number and a Weber number for the droplet ejected from the large nozzle and a product of a Reynolds number and a Weber number for the droplet ejected from the small nozzle are equal to each other. Each of the products is defined as:

$$Re \times We = \frac{\rho^2 \times V^3 \times D^2}{\mu \times \gamma},$$

where Re is the Reynolds number for the droplet, We is the Weber number for the droplet, ρ is a density of the liquid, V is a flight speed of the droplet, D is a diameter of the nozzle from which the droplet is ejected, μ is a viscosity of the liquid, and γ is a surface tension of the liquid.

3 Claims, 7 Drawing Sheets

IMAGE FORMING APPARATUS

BACKGROUND OF THE INVENTION

1. Field of the Invention

The present invention relates to an image forming apparatus, and more particularly to an image forming apparatus having large nozzles and small nozzles which eject droplets having different volumes.

2. Description of the Related Art

In a thermal-jet type of inkjet recording apparatus, which ejects droplets by using thermal energy generated by heating elements, a recording head (hereinafter, simply called a "head") having large nozzles and small nozzles which eject droplets of different volumes is used widely in order to achieve high-definition image recording. By varying the size (surface area) of the dots formed by the respective droplets ejected from the large and small nozzles, it is possible to represent a wide variety of densities.

When using a head of this kind, the flight speed of the droplets ejected from the small nozzles is faster than the flight speed of the droplets ejected from the large nozzles, and hence there is a difference between the large and small nozzles in the time from the ejection of the respective droplets until they land on the recording medium. In particular, in a method which records by repeatedly moving the head in the breadthways direction of the recording medium (a serial scanning method), displacement arises in the deposition positions of the droplets, due to this difference in the flight speed, and hence there is a problem in that image deterioration occurs. In order to resolve problems of this kind, for example, in Japanese Patent Application Publication No. 7-137240, deposition position displacement caused by difference in the flight speed of the respective droplets ejected from the large and small nozzles is corrected by controlling the ejection timings of the large and small nozzles.

However, it has been found that there are limitations on the improvement of image quality that can be achieved by simply controlling the ejection timings of the large and small nozzles. This is because not only do the respective droplets ejected from the large and small nozzles have different flight speeds, but they also differ in terms of the length of the droplet (the length of the column of the liquid), and the number and size of satellite droplets generated concomitantly with the main droplet, and the like. Therefore, similar shapes cannot be achieved for the large and small dots formed by the droplets comprising a main droplet and satellite droplets in this way, by means of simply controlling the ejection timing so as to cancel out difference in the flight speed of the droplets, as described in Japanese Patent Application Publication No. 7-137240.

In particular, in a region where the volume of the droplets ejected from the nozzles is equal to or less than 2 to 3 picoliters (pl), the ratio of the size of the satellite droplets with respect to the size of the main droplet becomes larger and the effect of same on the recorded image becomes greater. If the satellite droplets have a great effect in this way, then complicated calculation is required in the image processing, such as halftoning, and this creates major practical problems.

SUMMARY OF THE INVENTION

The present invention has been contrived in view of the foregoing circumstances, an object thereof being to provide an image forming apparatus capable of achieving good image quality while reducing the computational load relating to image processing.

In order to attain the aforementioned object, the present invention is directed to an image forming apparatus, comprising: a liquid ejection head which includes: a large nozzle and a small nozzle performing ejection of droplets of liquid, the droplet ejected from the large nozzle having volume larger than the droplet ejected from the small nozzle; and liquid flow channels corresponding to the large and small nozzles, the ejection of the droplets from the large and small nozzles being induced by formation of bubbles in the liquid in the corresponding liquid flow channels caused by applied thermal energy; and an ejection control device which controls the ejection of the droplets in such a manner that a product of a Reynolds number and a Weber number for the droplet ejected from the large nozzle and a product of a Reynolds number and a Weber number for the droplet ejected from the small nozzle are equal to each other, each of the products being defined as:

$$Re \times We = \frac{\rho^2 \times V^3 \times D^2}{\mu \times \gamma},$$

where Re is the Reynolds number for the droplet, We is the Weber number for the droplet, ρ is a density of the liquid, V is a flight speed of the droplet, D is a diameter of the nozzle from which the droplet is ejected, μ is a viscosity of the liquid, and γ is a surface tension of the liquid.

According to this aspect of the present invention, the dots formed by the droplets ejected from the large and small nozzles have similar shapes, and therefore, it is possible to achieve good image quality, while reducing the computational load relating to image processing.

Preferably, the ejection control device controls the ejection of the droplets by taking account of temperature-related variation in a physical property value of the liquid including at least one of the density, the viscosity and the surface tension.

According to this aspect of the present invention, it is possible to achieve optimal ejection control according to temperature-related change in the physical property values of the liquid.

Preferably, the volume of the droplet ejected from the small nozzle is not larger than 3 picoliters.

If the volume of the droplet is 3 picoliters (pl) or less, then the ratio of the size of the satellite droplet with respect to the main droplet becomes high and the ejection control of the present invention becomes more appropriate.

According to the present invention, the dots formed by the droplets ejected from the large and small nozzles have similar shapes, and therefore, it is possible to achieve good image quality, while reducing the computational load relating to image processing.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
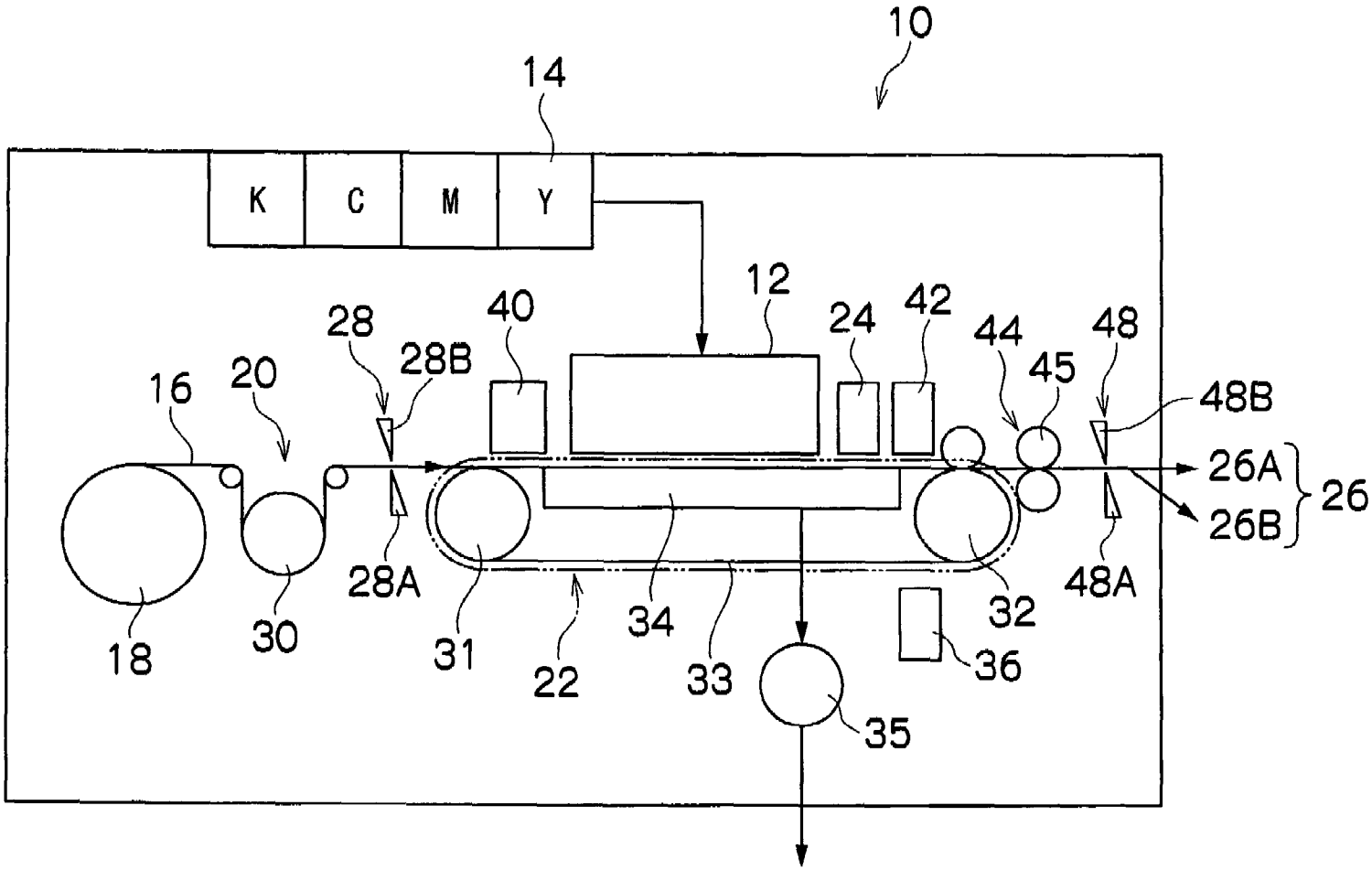
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a print unit 12 having a plurality of heads (liquid ejection heads) provided for respective ink colors of black (K), cyan (C), magenta (M), and yellow (Y); an ink storing and loading unit 14 for storing inks to be supplied to the respective heads; a paper supply unit 18 for supplying recording paper 16; a decurling unit 20 for removing curl in the recording paper 16; a suction belt conveyance unit 22, disposed facing the ink ejection surface (nozzle surface) of the print unit 12, for conveying the recording paper 16 while keeping the recording paper 16 flat; a print determination unit 24 for reading the printed result produced by the print unit 12; and a paper output unit 26 for outputting printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording body such as a bar code and a radio tag containing information about the type of paper is attached to the magazine, and by reading the information contained in the information recording body with a predetermined reading device, the type of paper to be used is automatically determined, and ink-droplet ejection is controlled so that the ink-droplets are ejected in an appropriate manner according to the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the ink ejection surface of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the ink ejection surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown in drawings) being transmitted to at least one of the rollers 31 and 32, which the belt 33 is set around, and the recording paper 16 held on the belt 33 is conveyed in the paper conveyance direction (the sub-scanning direction, the rightward direction in FIG. 1).

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include nipping of a brush roller and a water absorbent roller, an air blow configuration in which clean air is blown, or a combination of these. In the case of the configuration of nipping of the cleaning rollers, it is preferable to make the line velocity of the cleaning rollers different than that of the belt to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The ink storing and loading unit 14 has a tank for storing inks of colors corresponding to the respective heads in the print unit 12, and each tank is connected to the corresponding head by means of a channel (not shown). Moreover, the ink storing and loading unit 14 also has a notifying device (display device, alarm generating device, or the like) for generating a notification if the remaining amount of ink has become low, as well as having a mechanism for preventing incorrect loading of ink of the wrong color. The tanks may be based on ink cartridges composed in a detachable fashion with respect to the heads. In this case, ink is supplied directly from the ink cartridge to the head.

Each tank (or ink cartridge) is fitted with an information recording body which records information indicating the physical property values of the ink contained therein (such as the ink density, the ink viscosity, the ink surface tension, and so on). Similarly to the information recording body attached to the magazine as described above, this information recording body may be a barcode, a radio tag, or the like, for example. By reading in the information on the information recording body by means of a predetermined reading device, the physical property values of the ink inside the tank are acquired automatically, and ejection control as described below can be implemented by using these physical property values of the ink.

Alternatively, it is also possible to adopt a mode in which minimum information including identification information indicating the type of ink is recorded on a barcode attached on the ink cartridge, and information on the physical property values of the ink (including information on temperature dependence) is recorded for each of a plurality of types of ink, in a storage unit (not shown) of the inkjet recording apparatus 10, in such a manner that the information on the physical property values of the corresponding ink is retrieved from the storage unit according to the identification information of the type of the ink read on the barcode.

The print determination unit 24 has an image sensor (line sensor and the like) for capturing an image of the ink-droplet deposition result of the printing unit 12, and functions as a device to check for ejection defects such as clogs of the nozzles from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) for supplying recording paper 16. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

Figure 2:
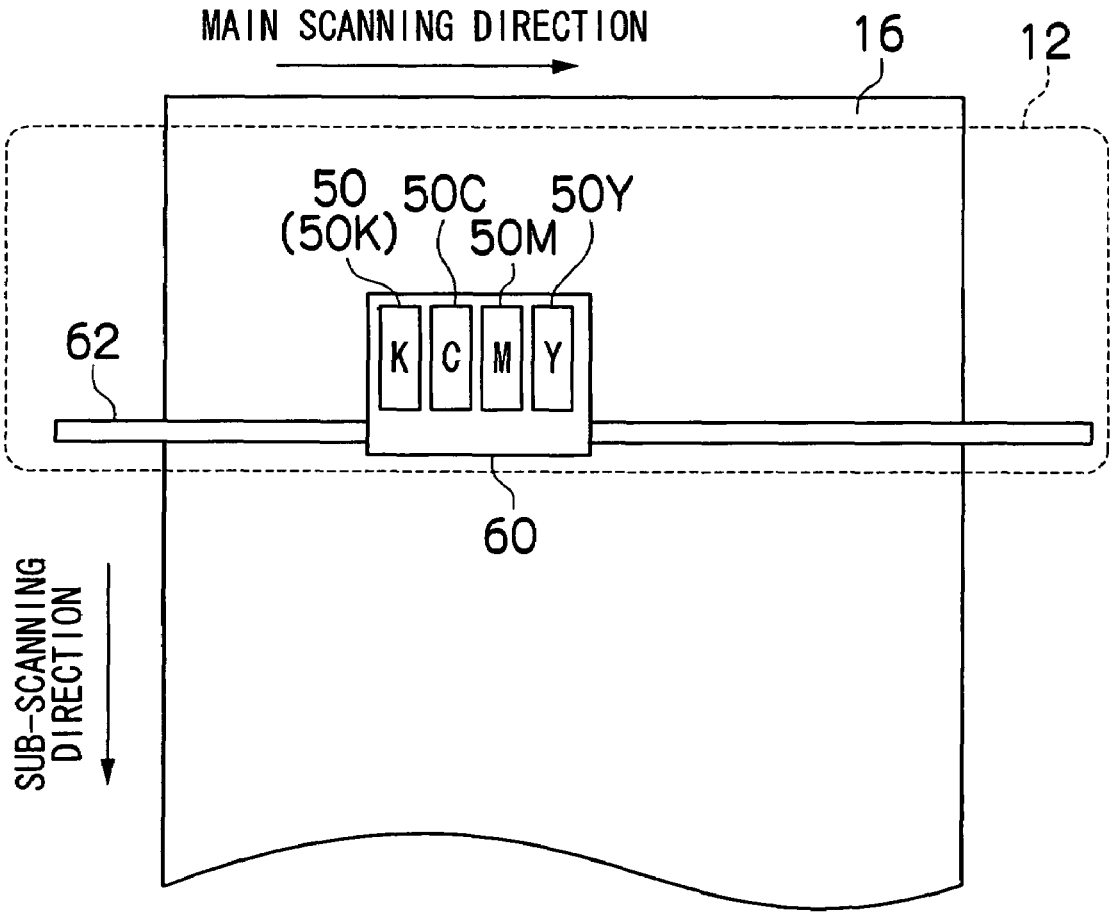
FIG. 2 is a plan diagram showing the peripheral part of a print unit constituting the main part of the inkjet recording apparatus.

FIG. 2 is a plan diagram showing the peripheral part of a print unit forming the principal composition of the inkjet recording apparatus of the present embodiment. The print unit 12 comprises heads 50 (50K, 50C, 50M and 50Y) corresponding respectively to the inks of the colors of black (K), cyan (C), magenta (M) and yellow (Y). A plurality of ejection ports (nozzles) for ejecting droplets are provided on the ink ejection surfaces (nozzle surfaces) of the heads 50, which oppose the recording paper 16. As described hereinafter, each of the heads 50 is provided with a plurality of large nozzles and a plurality of small nozzles, which eject droplets of different volumes.

A carriage 60 on which the heads 50 are mounted is composed so as be movable reciprocally along guide rails 62 extending in the breadthways direction of the recording paper 16 (the main scanning direction) by means of a carriage motor (not shown).

A desired image is recorded onto a recording medium 16 by ejecting droplets of corresponding colored inks respectively from the nozzles of the heads 50, while repeatedly scanning the heads 50 in the main scanning direction, and conveying the recording paper 16 in the sub-scanning direction (paper conveyance direction).

Although a configuration with the four standard colors, K, C, M and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

Figure 3A:
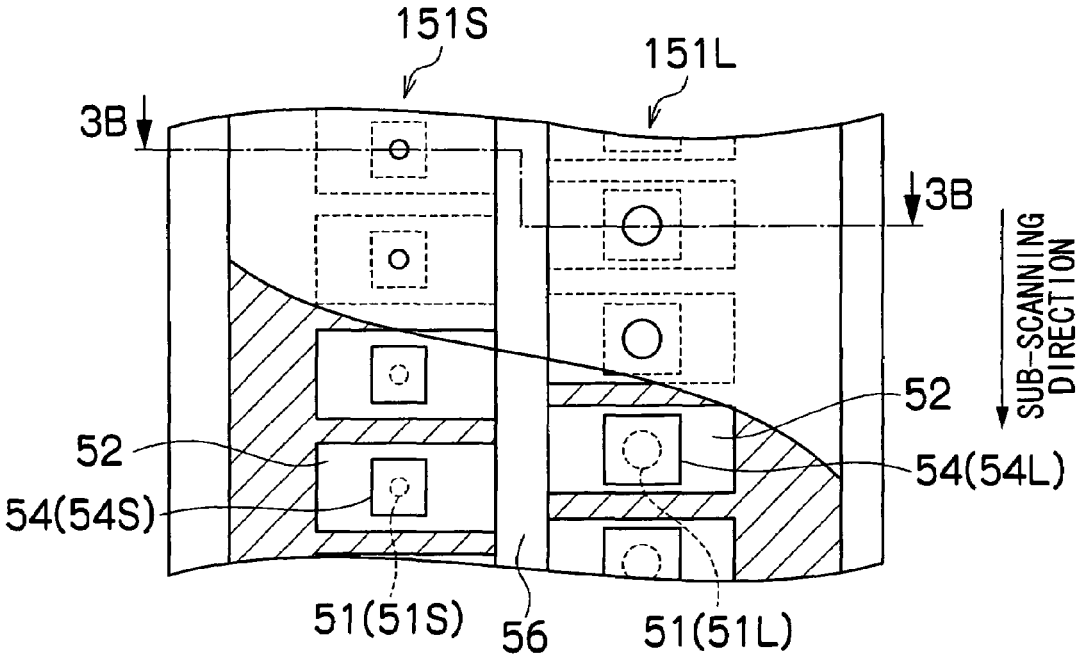
FIGS. 3A and 3B are compositional diagrams of the head.
Figure 3B:
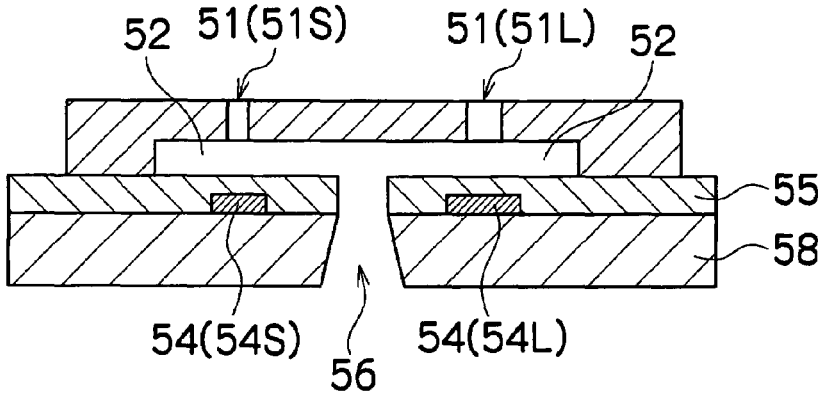

FIGS. 3A and 3B are schematic drawings of a head used in the inkjet recording apparatus according to the present embodiment. FIG. 3A is a plan diagram (partial cross-sectional diagram) viewed from the side of the ink ejection surface, and FIG. 3B is a cross-sectional diagram along line 3B-3B in FIG. 3A.

As shown in FIG. 3A, each head 50 is provided with a large nozzle row 151L, in which a plurality of large nozzles 51L are arranged along the sub-scanning direction, and a small nozzle row 151S, in which a plurality of small nozzles 51S are arranged along the sub-scanning direction. The opening surface area of each large nozzle 51L is greater than the opening surface area of each small nozzle 51S. The large nozzles 51L eject droplets having volume larger than droplets ejected from the small nozzles 51S.

In the large and small nozzle rows 151L and 151S, the nozzles 51 (the large and small nozzles 51L and 51S) are arranged at the same nozzle pitch along the sub-scanning direction. One of the large and small nozzle rows 151L and 151S is shifted by a prescribed amount (within one nozzle pitch) in the sub-scanning direction with respect to the other of the large and small nozzle rows 151L and 151S, thereby achieving a staggered arrangement in which the large nozzles 51L and the small nozzles 51S are not located in the same positions in the sub-scanning direction. In this nozzle arrangement, it is possible to cover over the intervals between large dots formed by droplets ejected from the large nozzles 51L, by means of small dots formed by droplets ejected from the small nozzles 51S, and it is thus possible to prevent density non-uniformities in the recorded image and to obtain an excellent effect in improving tonal graduation. It is preferable that the amount of shift between the large nozzle row 151L and the small nozzle row 151S in the sub-scanning direction is a half of the nozzle pitch. Of course, in implementing the present invention, the nozzle arrangement is not limited to that described above, and for example, it is also possible for the large nozzles 51L and the small nozzles 51S to be arranged at the same positions in the sub-scanning direction.

An individual flow channel 52 and a heater 54 corresponding to each nozzle 51 are provided inside the head 50. The individual flow channels 52 are defined by means of partitions, and ends of the individual flow channels 52 are connected to an ink supply port 56 formed between the large and small nozzle rows 151L and 151S. The ink stored in the ink storing and loading unit 14 in FIG. 1 is supplied to the individual flow channels 52 through the ink supply port 56.

As shown in FIG. 3B, the heaters 54 are arranged at positions corresponding to the nozzles 51 in the individual flow channels 52. The heater (large nozzle heater) 54L corresponding to the large nozzle 51L has a larger size and generates a greater thermal energy, in comparison with the heater (small nozzle heater) 54S corresponding to the small nozzle 51S. The heaters 54 (54L, 54S) are covered with a heater protection film 55, which also serves as a wall (the bottom wall) of the individual flow channel 52. The heater protection film 55 is formed on a substrate 58, and the ink supply port 56 is formed so as to pass through the heater protection film 55 and the substrate 58 in a long narrow shape extending in the sub-scanning direction.

In this composition, when a prescribed drive voltage is applied to the heater 54, a bubble grows in the ink inside the individual flow channel 52, due to the heat generated by the heater 54, and a droplet (ink droplet) is ejected from the nozzle 51 by the pressure created by this bubble. When the large nozzle heater 54L is driven, a large droplet is ejected from the large nozzle 51L located at the position opposing the driven large nozzle heater 54L, and a large dot is formed by the ejected and deposited large droplet on the recording paper 16. On the other hand, when the small nozzle heater 54S is driven, a small droplet is ejected from the small nozzle 51S located at the position opposing the driven small nozzle heater 54S, and a small dot is formed by the ejected and deposited small droplet on the recording paper 16.

Figure 4:
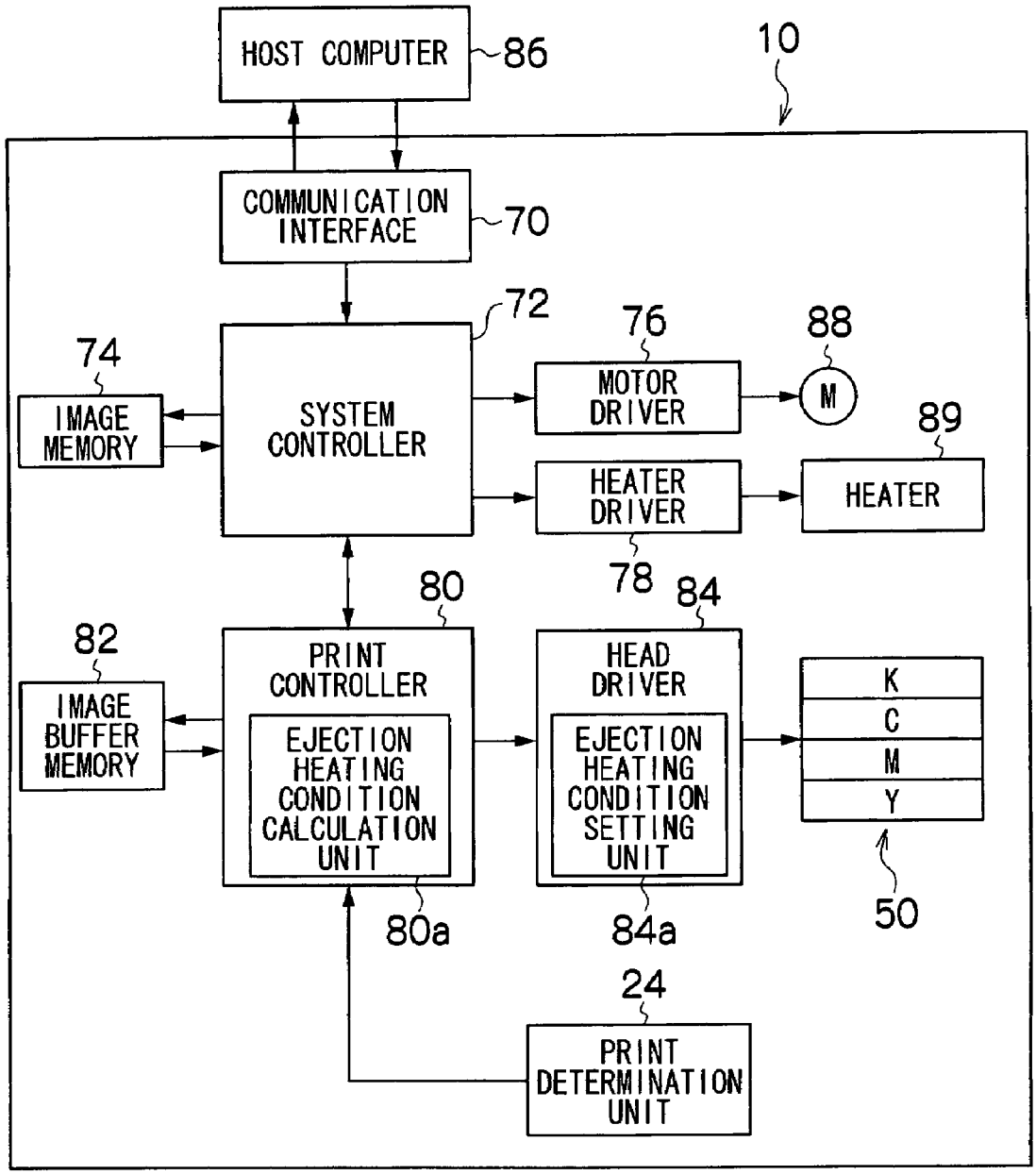
FIG. 4 is a principal block diagram showing the system composition of the inkjet recording apparatus.

FIG. 4 is a principal block diagram showing the system composition of the inkjet recording apparatus according to the present embodiment. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data transmitted by a host computer 86. A serial interface or a parallel interface may be used for the communication interface 70. It is also possible to install a buffer memory (not shown) for achieving high-speed communications.

The image data sent from the host computer 86 is read into the inkjet recording apparatus 10 through the communication interface 70, and is stored temporarily in the image memory 74. The image memory 74 is a storage device for temporarily storing the image data inputted through the communication interface 70, and the data is written to and read from the image memory 94 through the system controller 72. The image memory 74 is not limited to a memory composed of semiconductor elements, and a magnetic medium, such as a hard disk, or the like, may also be used.

The system controller 72 is a control unit for controlling the various sections, such as the communication interface 70, the image memory 74, the motor driver 76, the heater driver 78, and the like. The system controller 72 is constituted by a central processing unit (CPU) and peripheral circuits thereof, and the like. The system controller 72 controls communications with the host computer 86 and reading and writing from and to the image memory 74, or the like, and also generates control signals for controlling a motor 88 of the conveyance system and the heater 89.

The motor driver 76 is a driver (drive circuit) which drives the motor 88 according to commands from the system controller 72. The heater driver 78 drives the heater 89 of the post-drying unit 42 and other sections according to commands from the system controller 72.

The print controller 80 is a control unit having a signal processing function for performing various treatment processes, corrections, and the like, according to the control implemented by the system controller 72, in order to generate a signal for controlling printing from the image data in the image memory 74. The print controller 80 supplies the generated print control signal (dot data) to the head driver 84. Prescribed signal processing is carried out in the print controller 80, and the ejection amount and the ejection timing of the ink droplets from the heads 50 are controlled through the head driver 84, on the basis of the image data. By this means, prescribed dot sizes and dot positions can be achieved. The ejection control according to the present invention described below is carried out principally by the print controller 80.

The image buffer memory 80 is provided in the print controller 82, and the image data, parameters, and other data are temporarily stored in the image buffer memory 80 when the image data is processed in the print controller 82. FIG. 4 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

The head driver 84 generates drive signals for driving the heaters 54 (see FIGS. 3A and 3B) in the heads 50 of the respective colors on the basis of the dot data supplied from the print controller 80, and supplies the generated drive signals to the heaters 54. A feedback control system for maintaining constant drive conditions for the heads 50 may be included in the head driver 84.

The print determination unit 24 reads in a test pattern recorded by the heads 50, and performs prescribed signal processing, and the like, in order to determine the ink ejection status of the heads 50 (the presence/absence of ejection, the dot sizes, the dot positions, and the like). The print determination unit 24 supplies the determination results to the print controller 80. According to requirements, the print controller 80 makes various corrections with respect to the heads 50 on the basis of information obtained from the print determination unit 24.

Next, the ejection control carried out in the inkjet recording apparatus according to the present embodiment, which is one of the characteristic features of the present invention, is described in detail.

According to researches carried out by the present inventor, it has been found that if the product of the Reynolds number Re and the Weber number We for the droplet (large droplet) ejected from the large nozzle 51L and the product of the Reynolds number Re and the Weber number We for the droplet (small droplet) ejected from the small nozzle 51S are equal to each other, then the dots formed by the large and small droplets deposited on the recording medium have shapes similar to each other. Here, the product of the Reynolds number Re and the Weber number We for the droplet is defined as:

$$Re \times We = \frac{\rho^2 \times V^3 \times D^2}{\mu \times \gamma}, \quad (1)$$

where ρ (kg/m$^3$) is the density of the liquid, V (m/sec) is the flight speed of the ejected droplet, D (m) is the diameter of the nozzle from which the droplet is ejected, μ (Pa·s) is the viscosity of the liquid, and γ (N/m) is the surface tension of the liquid.

Figure 5:
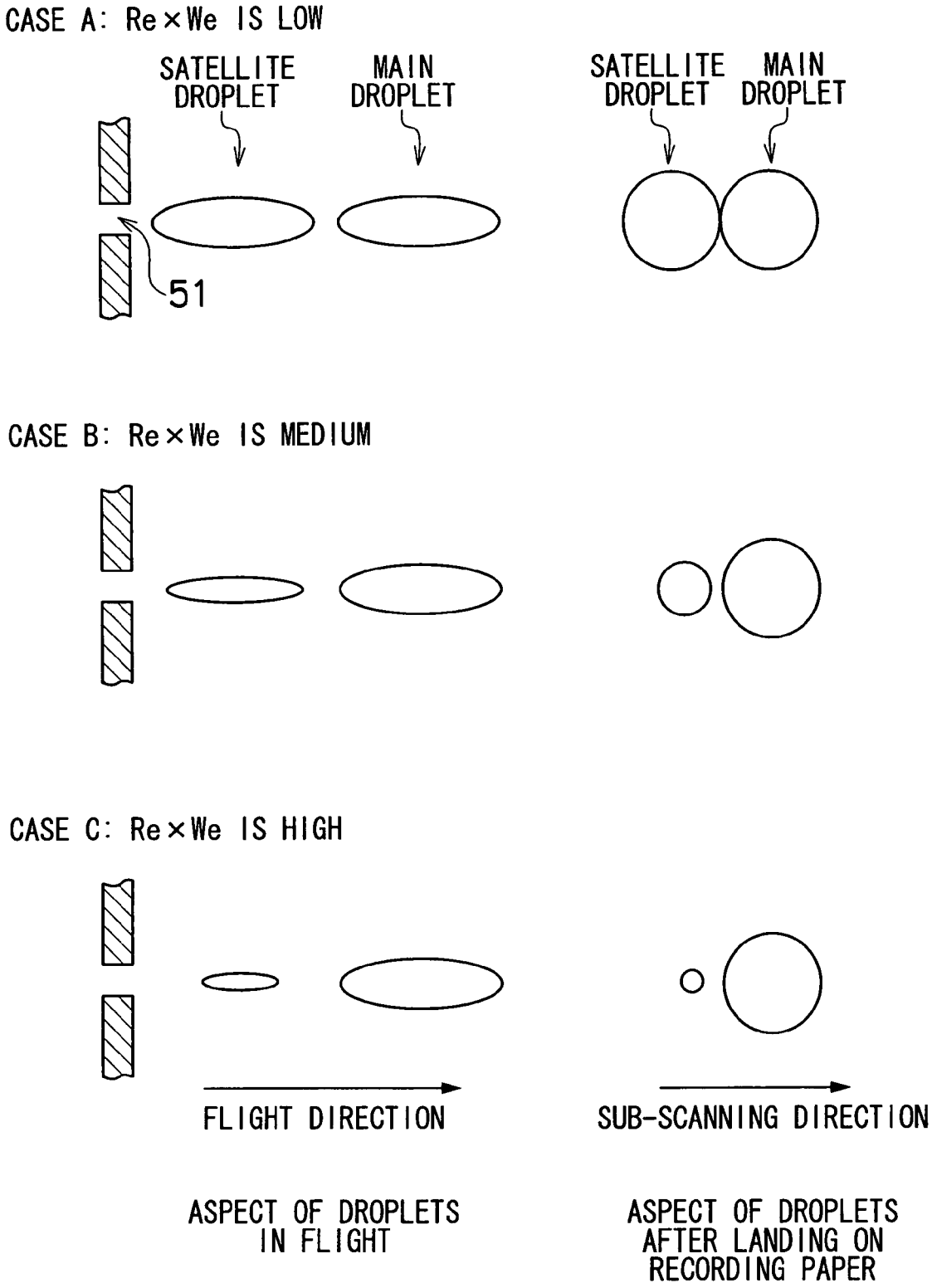
FIG. 5 is a diagram for describing the relationships between main droplets and satellite droplets.

FIG. 5 is a diagram for describing the relationships between main droplets and satellite droplets, in cases A, B and C where the products of the Reynolds numbers Re and the Weber numbers We for the droplets have a low value, a medium value and a high value, respectively. The left-hand side in the diagram shows the states of the droplets ejected from the nozzle in flight, and the right-hand side in the diagram shows the states where these droplets have landed on the recording paper 16.

For example, in the case A where the product of the Reynolds number Re and the Weber number We is low, the inertia is relatively lower with respect to the viscosity and the surface tension, and therefore the ratio of the size of the satellite droplet with respect to the size of the main droplet is large. On the other hand, in the case C where the product of the Reynolds number Re and the Weber number We is high, the inertia is relatively higher with respect to the viscosity and the surface tension, and therefore the ratio of the size of the satellite droplet with respect to the size of the main droplet is small.

Consequently, if the respective products of the Reynolds numbers Re and the Weber numbers We are set equally to a high value for both the large nozzle 51L and the small nozzle 51S, then dots having shapes similar to each other and accompanied with small satellite dots are formed, as in the case C in FIG. 5, and if the respective products of the Reynolds numbers Re and the Weber numbers We are set equally to a low value for both the large and small nozzles 51L and 51S, then dots having similar shapes and accompanied with large satellite dots are formed, as in the case A in FIG. 5.

On the basis of this, the characteristic features of the present invention include that ejection is controlled in such a manner that the respective products of the Reynolds numbers Re and the Weber numbers We are the same with respect to the droplets ejected from both the large and the small nozzles 51L and 51S. In other words, the ejection is controlled under conditions satisfying the following relationship:

$$\frac{\rho_1^2 \times V_1^3 \times D_1^2}{\mu_1 \times \gamma_1} = \frac{\rho_2^2 \times V_2^3 \times D_2^2}{\mu_2 \times \gamma_2}, \quad (2)$$

where the variables corresponding to the large nozzle 51L are indicated by the subscript suffix "1", and the variables corresponding to the small nozzle 51S are indicated by the subscript suffix "2".

Figure 6:
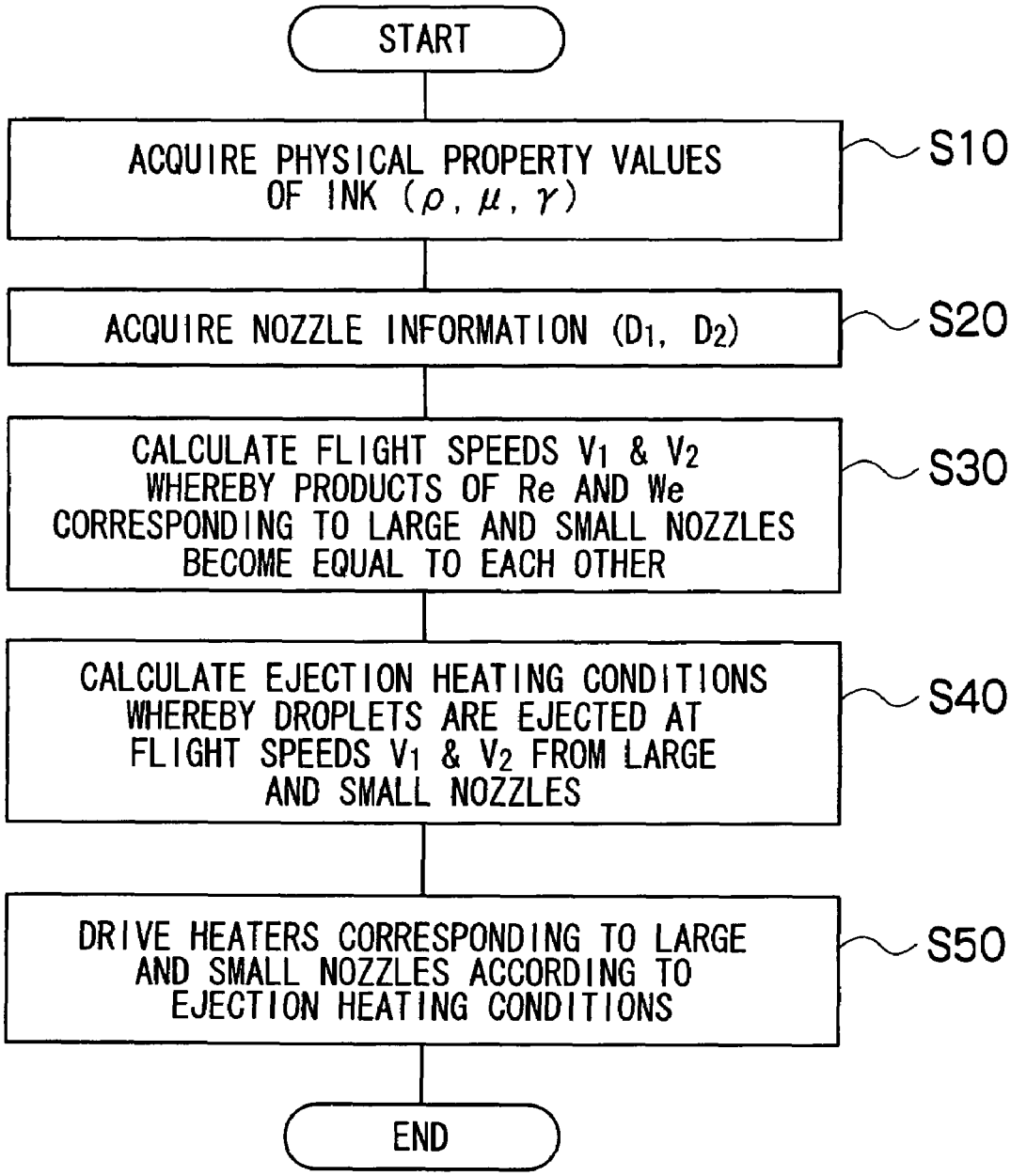
FIG. 6 is a flowchart showing ejection control according to an embodiment of the present invention.

FIG. 6 is a flowchart showing an ejection control procedure according to an embodiment of the present invention. Below, the ejection control according to the present embodiment is described in detail with reference to the flowchart shown in FIG. 6. The processing in the present ejection control is carried out principally by the print controller 80 and the head driver 84 (see FIG. 4).

Firstly, the physical property values of the ink are acquired (step S10). More specifically, the ink density ρ, the ink viscosity μ, and the ink surface tension γ are acquired as the physical property values of the ink used in the inkjet recording apparatus 10 according to the present embodiment. These physical property values of the ink are the values at a representative temperature (standard temperature) arbitrarily determined beforehand. In the present embodiment, the physical property values of the ink are acquired by reading in the information on the information recording body attached to the ink tank (or ink cartridge) by means of a predetermined reading device.

Next, the nozzle diameter $D_1$ of the large nozzles 51L and the nozzle diameter $D_2$ of the small nozzles 51S are acquired as nozzle information (step S20). For example, it is possible that the nozzle information is stored beforehand in a storage unit (not shown) of the inkjet recording apparatus 10, and the nozzle information is retrieved from this storage unit.

The sequence of acquisition of the physical property values of the ink and the nozzle information is not limited to the embodiment shown in FIG. 6. For example, it is possible to acquire the nozzle information before the physical property values of the ink, and it is also possible to simultaneously acquire the physical property values of the ink and the nozzle information.

Next, the respective flight speeds $V_1$ and $V_2$ of the droplets to be ejected from the large nozzles 51L and the small nozzles 51S are calculated so that the flight speeds satisfy the conditions represented with the above-described formula (2) whereby the respective products of the Reynolds numbers Re and the Weber numbers We become equal to each other for all the droplets (step S30).

Thereupon, the ejection heating conditions are calculated so as to cause the droplets to be ejected at the flight speeds $V_1$ and $V_2$ calculated in step S30, from the large nozzles 51L and the small nozzles 51S, respectively (step S40). Here, the ejection heating conditions include the heating start timing, the heating time, and the heating input energy, corresponding to each of the heaters 54L and the heaters 54S. The ejection heating conditions are calculated by an ejection heating condition calculation unit 80*a* within the print controller 80 (see FIG. 4).

For example, in order to obtain a high flight speed, the heating input energy per unit heating time should be set to a high value. On the other hand, in order to obtain a low flight speed, the heating input energy per unit heating time should be set to a low value.

Thereupon, the heaters 54L and 54S corresponding to the large and small nozzles 51L and 51S are driven according to the ejection heating conditions calculated at step S40 (step S50). Thus, the respective products of the Reynolds numbers Re and the Weber numbers We for the droplets ejected from the large nozzles 51L and the small nozzles 51S become equal to each other. Accordingly, the dots formed by these droplets have similar shapes, and hence good image quality can be achieved while reducing the calculational load required for image processing.

In the ejection control carried out according to the flowchart in FIG. 6, variations in the physical property values with temperature change are not taken into account; however, depending on the ejection heating conditions of the heaters 54L and 54S, and the types of ink, situations may arise in which such temperature-related variations in the physical property values cannot be ignored. Therefore, it is more desirable that the ejection control is carried out by taking account of the temperature-related variations of the physical property values of the ink.

Figure 7:
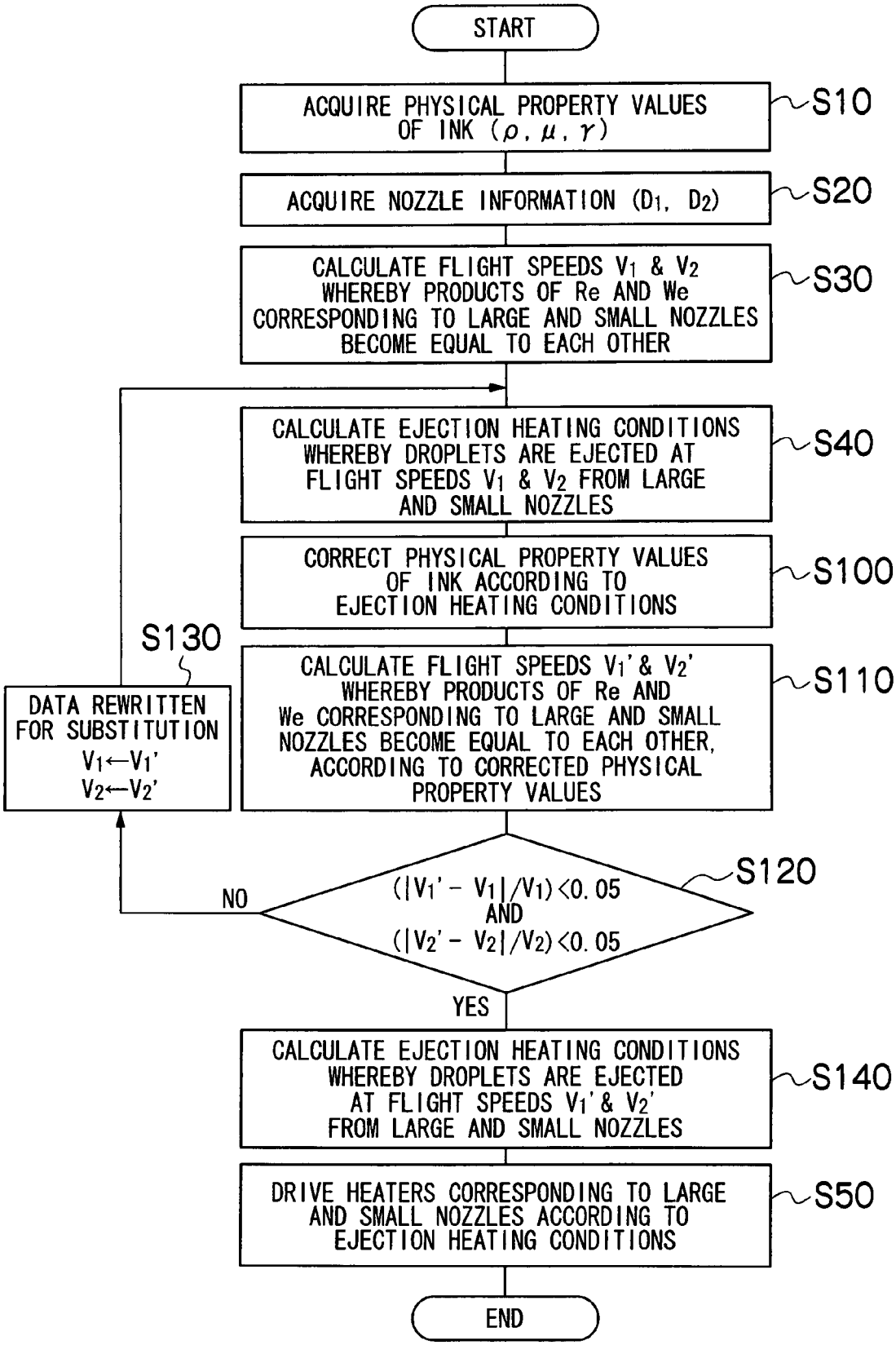
FIG. 7 is a flowchart showing ejection control according to an embodiment of the present invention in a case where temperature-related variations in the physical property values of the ink are taken into account.

FIG. 7 is a flowchart showing the ejection control according to an embodiment of the present invention, in which the temperature-related variations in the physical property values of the ink are taken into account. In FIG. 7, the processes common to the flowchart shown in FIG. 6 are denoted with the same step numbers, and descriptions thereof are omitted here.

In this ejection control, after calculating the ejection heating conditions at step S40, the physical property values of the ink are corrected for the respective nozzles, according to the temperature change of the ink obtained on the basis of these ejection heating conditions (step S100). Thereby, the temperature-corrected physical property values of the ink ($\rho_1$, $\mu_1$, $\gamma_1$) corresponding to the large nozzles 51L and the temperature-corrected physical property values of the ink ($\rho_2$, $\mu_2$, $\gamma_2$) corresponding to the small nozzles 51S are obtained.

Thereupon, by using the temperature-corrected physical property values of the ink ($\rho_1$, $\mu_1$, $\gamma_1$, $\rho_2$, $\mu_2\gamma_2$), the respective flight speeds $V_1'$ and $V_2'$ that satisfy conditions for achieving the equal value for the respective products of the Reynolds numbers Re and the Weber numbers We for the droplets ejected from the large nozzles 51L and the small nozzles 51S, are calculated (step S110).

Then, it is determined whether or not both the rate of change of the flight speed $V_1'$ with respect to the flight speed $V_1$ (i.e., $|V_1'-V_1|/V_1$) and the rate of change of the flight speed $V_2'$ with respect to the flight speed $V_2$ (i.e., $|V_2'-V_2|/V_2$) are smaller than a prescribed threshold value (e.g., 0.05 in the present embodiment) (step S120).

If it is judged that at least one of these rates of change is not smaller than the prescribed threshold value (i.e., if the verdict in step S120 is No), then the data is rewritten to substitute the flight speed $V_1'$ for the flight speed $V_1$, and the flight speed $V_2'$ for the flight speed $V_2$ (step S130). After the data rewriting, the procedure returns to step S40, where similar processing is repeated to calculate ejection heating conditions satisfying the new flight speeds $V_1$ and $V_2$.

On the other hand, if it is judged that both of the rates of change are smaller than the prescribed threshold value (i.e., if the verdict in step S120 is Yes), then ejection heating conditions whereby droplets are ejected at the flight speeds $V_1'$ and $V_2'$ from the large and small nozzles 51L and 51S, respectively, are calculated (step S140), and the heaters 54L and 54S are driven according to these ejection heating conditions (step S50). The ejection is thus controlled while taking account of the temperature-related change in the physical property values of the ink.

As described above, according to the present embodiment, the ejection is controlled in such a manner that the respective products of the Reynolds numbers Re and the Weber numbers We are equal to each other for the droplets ejected from the large nozzle 51L and the small nozzle 51S, then the dots formed by these droplets have shapes similar to each other, and therefore it is possible to achieve good image quality while reducing the calculational load relating to image processing.

In the present embodiment, it is particularly preferable that the ejection control is carried out by taking account of the temperature variations of the physical values of the ink. The optimal ejection control is thereby possible, even if there are considerable temperature-related changes in the physical property values of the ink.

Furthermore, it is desirable that the volume of the droplets ejected from at least the small nozzles, of the large and small nozzles, is 3 picoliters (pl) or less. In this case, the ratio of the size of the satellite droplet to the size of the main droplet is high, and hence the ejection control according to the present invention is particularly appropriate.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a liquid ejection head which includes: a large nozzle and a small nozzle performing ejection of droplets of liquid, the droplet ejected from the large nozzle having volume larger than the droplet ejected from the small nozzle; and liquid flow channels corresponding to the large and small nozzles, the ejection of the droplets from the large and small nozzles being induced by formation of bubbles in the liquid in the corresponding liquid flow channels caused by applied thermal energy; and an ejection control device which controls the ejection of the droplets in such a manner that a product of a Reynolds number and a Weber number for the droplet ejected from the large nozzle and a product of a Reynolds number and a Weber number for the droplet ejected from the small nozzle are equal to each other, each of the products being defined as:

$$Re \times We = \frac{\rho^2 \times V^3 \times D^2}{\mu \times \gamma},$$

where Re is the Reynolds number for the droplet, We is the Weber number for the droplet, $\rho$ is a density of the liquid, V is a flight speed of the droplet, D is a diameter of the nozzle from which the droplet is ejected, $\mu$ is a viscosity of the liquid, and $\gamma$ is a surface tension of the liquid.

2. The image forming apparatus as defined in claim 1, wherein the ejection control device controls the ejection of the droplets by taking account of temperature-related variation in a physical property value of the liquid including at least one of the density, the viscosity and the surface tension.

3. The image forming apparatus as defined in claim 1, wherein the volume of the droplet ejected from the small nozzle is not larger than 3 picoliters.

* * * * *